US007686431B2

(12) United States Patent
Takatsuka

(10) Patent No.: US 7,686,431 B2
(45) Date of Patent: Mar. 30, 2010

(54) LIQUID DROPLET EJECTION HEAD AND IMAGE FORMING APPARATUS

(75) Inventor: Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 621 days.

(21) Appl. No.: 11/515,869

(22) Filed: Sep. 6, 2006

(65) Prior Publication Data

US 2007/0052763 A1 Mar. 8, 2007

(30) Foreign Application Priority Data

Sep. 7, 2005 (JP) ..... 2005-259712

(51) Int. Cl.
*B41J 2/045* (2006.01)

(52) U.S. Cl. ..... 347/68

(58) Field of Classification Search ..... 347/65, 347/68–72
See application file for complete search history.

(56) References Cited

U.S. PATENT DOCUMENTS 5,746,816 A * 5/1998 Xu ..... 106/31.25
6,523,942 B2 * 2/2003 Sakamoto et al. ..... 347/68

FOREIGN PATENT DOCUMENTS

JP 2003-72104 A 3/2003
WO WO 2004/110768 A1 * 12/2004

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The liquid droplet ejection head includes: a nozzle which ejects a droplet of a liquid containing microparticles; a pressure chamber which connects with the nozzle; a piezoelectric element which varies a volume of the pressure chamber; a common liquid chamber which stores the liquid that is to be supplied to the pressure chamber; and a supply passage which connects the common liquid chamber to the pressure chamber, wherein the supply passage has a plurality of supply ports through which the common liquid chamber is connected to the supply passage, the supply ports being disposed in different positions in a direction of gravitational force.

6 Claims, 13 Drawing Sheets

LIQUID DROPLET EJECTION HEAD AND IMAGE FORMING APPARATUS

BACKGROUND OF THE INVENTION

1. Field of the Invention

The present invention relates to a liquid droplet ejection head and an image forming apparatus, and more particularly to a liquid droplet ejection head and an image forming apparatus which each eject a functional liquid containing dispersed microparticles.

2. Description of the Related Art

An inkjet printer (inkjet recording apparatus) is known as an image forming apparatus. An inkjet printer comprises an inkjet head (liquid droplet ejection head) in which a large number of nozzles (liquid droplet ejection ports) is arranged, and records an image or pattern on a recording medium by ejecting ink in the form of liquid droplets through the nozzles toward the recording medium while moving the inkjet head and the recording medium relatively to each other.

For example, an inkjet head of such an inkjet printer comprises a pressure chamber unit including: a pressure chamber which is supplied with ink from an ink tank via an ink supply passage (common liquid chamber); a piezoelectric element which is driven by electric signals corresponding to image data; a diaphragm constituting a part of the pressure chamber, which is deformed by driving the piezoelectric element; and a nozzle which communicates with the pressure chamber and ejects the ink in the pressure chamber in the form of liquid droplets when the volume of the pressure chamber decreases due to the deformation of the diaphragm. By combining dots formed by the ink that is ejected through the nozzles of the pressure generating units in the inkjet printer, an image or pattern is formed on a recording medium.

In recent years, inkjet printers have been used not only to form images by depositing a liquid such as ink on a sheet of recording paper, but also to form patterns and the like by ejecting a functional liquid containing dispersed microparticles. Embodiments of the microparticles that may be used include pigment, polymer resin, metal, glass, and oxides or compounds thereof.

When a raw material such as those described above is formed into microparticles and the microparticles are then dispersed and emulsified into a solvent liquid using a dispersing agent, the microparticles in the liquid aggregate and settle over time. If a functional liquid containing these aggregated and settled microparticles is ejected as is, unevenness occurs in the concentration or microparticle density of the liquid, leading to concentration unevenness or distortion in the ejection result and deterioration of the color reproducibility. As a result, it is difficult to maintain a high ejection result quality.

Under such circumstances, for example, Japanese Patent Application Publication No. 2003-72104 discloses an apparatus that maintains microparticles in a functional liquid in a consistently dispersed state. In the apparatus, a manifold (common liquid chamber) in which an ejection substance accumulates immediately before being ejected through a nozzle is provided in the interior of an ejection head. The manifold is provided with a stirring device such as a piezoelectric element, for example, and hence vibration is provided by the stirring device to the ejection substance in the manifold such that the ejection substance is stirred constantly.

As noted above, in a functional liquid containing dispersed microparticles, the microparticles in the liquid aggregate and settle over time. Particularly when the functional liquid is an adjusted ink in which a raw color material formed into microparticles is dispersed through a solvent liquid, the color material in the ink aggregates and settles over time such that the ink concentration is greater in a lower layer portion than an upper layer portion. When such ink is ejected by an ejection head structured such that the ink is supplied to a pressure chamber through a supply passage from the lower portion of a common liquid chamber, the thick ink that has settled near the bottom portion of the common liquid chamber is supplied first. As the ink is consumed by the print operation, the density of the image formed by the ejected ink gradually shifts from dark to light, and hence the image quality deteriorates.

In the apparatus disclosed in Japanese Patent Application Publication No. 2003-72104, in order to solve the problem described above by preventing the microparticles in the liquid from settling, the microparticles are maintained in a consistently dispersed state by providing the piezoelectric element as a device for stirring the ejection substance in the common liquid chamber (manifold) so that the ejection substance is subjected to vibration and stirred at all times. However, this stirring mechanism requires a drive circuit to drive the piezoelectric element, a control device to synchronize the stirring operation and ejection operation, and the like, leading to an increase in cost.

SUMMARY OF THE INVENTION

The present invention is contrived in view of the aforementioned circumstances, an object thereof being to provide a liquid droplet ejection head and an image forming apparatus which can each eliminate visible density difference in an image deposited on a recording medium, using a reasonably-priced constitution without the need for a stirring mechanism which actively stirs the ejection substance, such as that described above, even when microparticles settle in a liquid and the concentration or density of the liquid become uneven.

In order to attain the aforementioned object, the present invention is directed to a liquid droplet ejection head comprising: a nozzle which eject a droplet of a liquid containing microparticles; a pressure chamber which connects with the nozzle; a piezoelectric element which varies a volume of the pressure chamber; a common liquid chamber which stores the liquid that is to be supplied to the pressure chamber; and a supply passage which connects the common liquid chamber to the pressure chamber, wherein the supply passage has a plurality of supply ports through which the common liquid chamber is connected to the supply passage, the supply ports being disposed in different positions in a direction of gravitational force.

According to this aspect of the present invention, even when the microparticles in the liquid settle, a low concentration liquid and a high concentration liquid can be stirred effectively using a reasonably-priced and simple structure, and hence the liquid where the microparticles have a substantially constant concentration and density can be ejected.

In order to attain the aforementioned object, the present invention is also directed to a liquid droplet ejection head comprising: nozzles which respectively eject droplets of a liquid containing microparticles onto a recording medium; pressure chambers which connect with the nozzles; piezoelectric elements which vary volumes of the pressure chambers; at least one common liquid chamber which stores the liquid to be supplied to the pressure chambers; and supply passages which connect the at least one common liquid chamber to the pressure chambers, wherein the droplets ejected from the nozzles are adjacent to each other on the recording medium; and the supply passages respectively have supply ports through which the at least one common liquid chamber is connected to the supply passages, the supply ports being disposed in different positions in a direction of gravitational force.

According to this aspect of the present invention, even when the microparticles in the liquid settle, high-quality image recording with no visible density difference can be realized. Moreover, the liquid containing the microparticles can be stirred effectively.

In order to attain the aforementioned object, the present invention is also directed to a liquid droplet ejection head comprising: a nozzle which ejects a droplet of a liquid containing microparticles; a pressure chamber which connects with the nozzle; a piezoelectric element which varies a volume of the pressure chamber; a common liquid chamber which stores the liquid that is to be supplied to the pressure chamber; and supply passages which connect the common liquid chamber to the pressure chamber, wherein the supply passages respectively have supply ports through which the common liquid chamber is connected to the supply passages, the supply ports being disposed in different positions in a direction of gravitational force.

According to this aspect of the present invention, even when the microparticles in the liquid settle, a low concentration liquid and a high concentration liquid can be stirred effectively using a reasonably-priced and simple structure, and hence the liquid where the microparticles have a substantially constant concentration and density can be ejected.

In order to attain the aforementioned object, the present invention is also directed to an image forming apparatus comprising one of the above liquid droplet ejection heads.

According to this aspect of the present invention, even when the microparticles in the liquid settle, high-quality image recording with no visible density difference can be realized.

According to the present invention, even when the microparticles in the liquid settle, a low concentration liquid and a high concentration liquid can be stirred effectively using a reasonably-priced and simple structure, and hence the liquid where the microparticles have a substantially constant concentration and density can be ejected.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

10

DETAILED DESCRIPTION OF THE PREFERRED EMBODIMENTS

Figure 1:
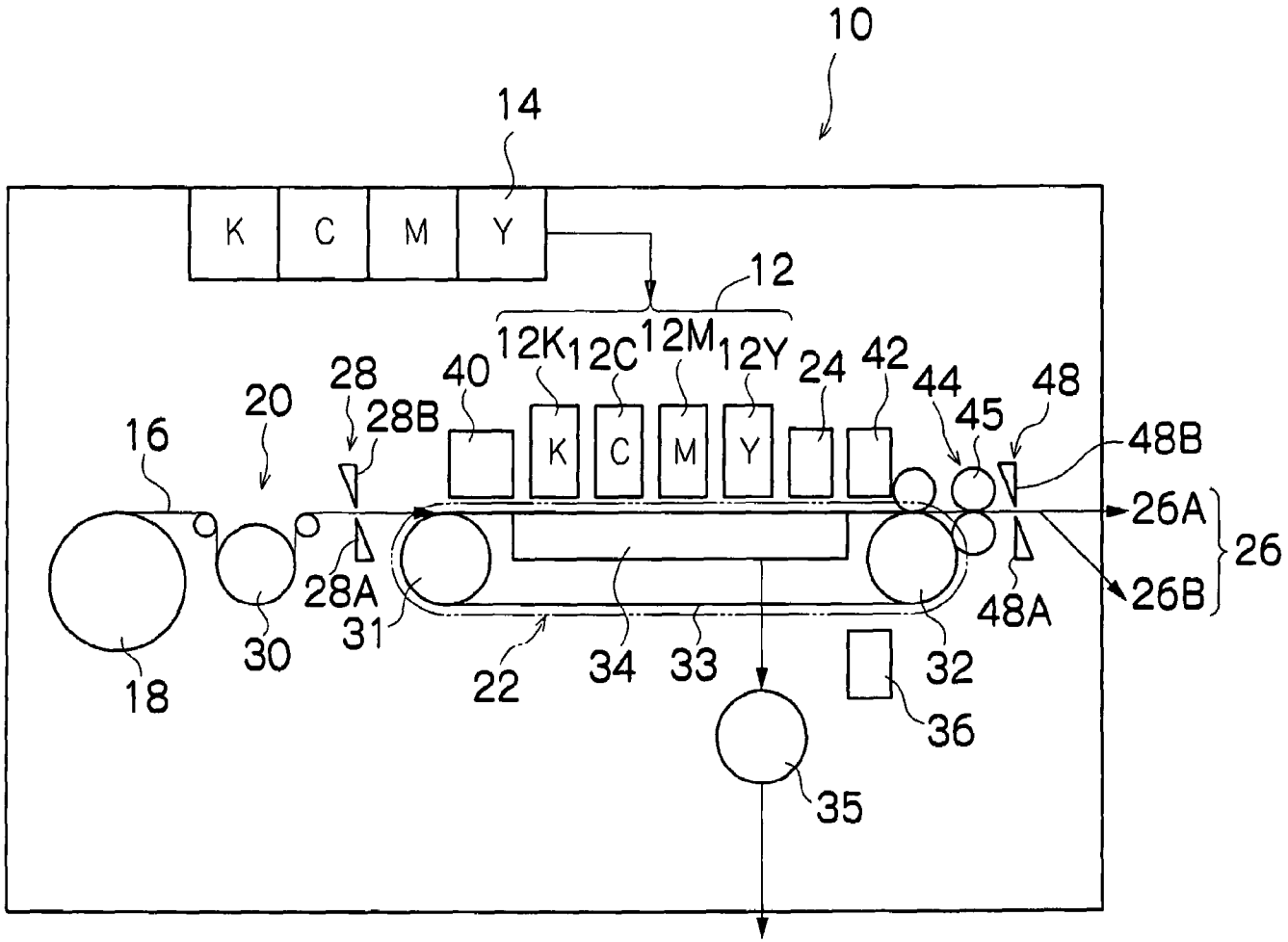
FIG. 1 is a general schematic drawing illustrating a first embodiment of an inkjet recording apparatus which serves as an image forming apparatus comprising a liquid droplet ejection head according to an embodiment of the present invention.

FIG. 1 is a general schematic drawing illustrating a first embodiment of an inkjet recording apparatus that serves as an image forming apparatus comprising a liquid droplet ejection head according to an embodiment of the present invention.

As shown in FIG. 1, the inkjet recording apparatus 10 comprises: a print unit 12 having a plurality of print heads (liquid ejection head) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

As shown in FIG. 1, in the case of an apparatus constitution employing rolled paper, a cutter 28 is provided, and the rolled paper is cut into the desired size by the cutter 28. The cutter 28 is constituted by a stationary blade 28A having a length which is equal to or greater than the width of the conveyance path for the recording paper 16, and a round blade 28B which moves along the stationary blade 28A. The stationary blade 28A is provided on the rear side of the print surface, and the round blade 28B is disposed on the print surface side so as to sandwich the conveyance path together with the stationary blade 28A. Note that when cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism instead of the suction belt conveyance unit 22. However, there is a possibility in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed before the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 forms a so-called full-line head (see FIG. 2) in which line heads having a length which corresponds to the maximum paper width are disposed in an orthogonal direction (main scanning direction) to the paper conveyance direction (sub-scanning direction).

Figure 2:
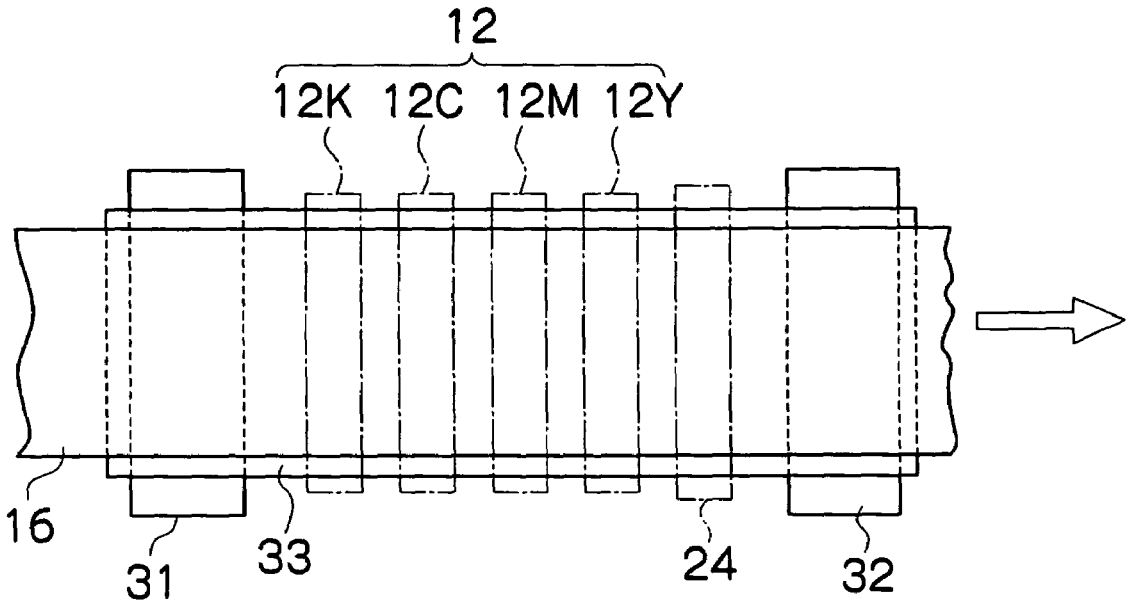
FIG. 2 is a plan view of the principal components on the periphery of a print unit of the inkjet recording apparatus shown in FIG. 1.

As shown in FIG. 2, each print head 12K, 12C, 12M, and 12Y is constituted as a line head in which a plurality of ink ejection ports (nozzles) are arranged over a length which exceeds at least one side of the maximum sized recording paper 16 that can be used in the inkjet recording apparatus 10.

The print heads 12K, 12C, 12M, and 12Y corresponding to the ink colors are disposed in order of black (K), cyan (C), magenta (M), and yellow (Y) from the upstream side (the left side in FIG. 1) in the conveyance direction (paper conveyance direction) of the recording paper 16. A color image can be formed on the recording paper 16 by depositing colored ink thereon from the respective print heads 12K, 12C, 12M, and 12Y while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction (main-scanning direction) that is perpendicular to the paper conveyance direction.

Note that in this embodiment, functional ink containing dispersed microparticles is ejected, and hence ink containing a dispersed color material which is insoluble or hardly-soluble in water is suitable for use in this embodiment. Embodiments of the color material include a dispersion dye, a metal complex salt dye, and a pigment. A so-called dispersing agent, surface active agent, resin, or the like may be used as a compound for dispersing the color material into an ink solvent. As a dispersing agent or a surface active agent, an anionic substance, a nonionic substance, or other substances may be employed. Embodiments of a resin dispersing agent include a set of styrene and the dielectric, a set of vinyl naphthalene and the dielectric, and a set of acrylic acid and the dielectric. These resins are preferably alkali-soluble resins that are soluble in an aqueous solution containing a dissolved base. The pigment may be an inorganic pigment or an organic pigment, although the present invention is not limited thereto. Pigmented ink exhibits excellent light resistance and water resistance, but settlement is more likely to occur than in a dye ink.

When this type of functional ink is used in a shuttle head, the head itself performs a reciprocating motion in the main scanning direction while the recording medium is conveyed in the sub-scanning direction, and hence the functional ink in the head is stirred constantly so that settlement of the microparticles in the functional ink does not pose a problem. In a line head such as that of this embodiment, however, the head itself is usually stationary while the recording medium is conveyed, and hence settlement of the microparticles in the functional ink may become problematic. According to the present embodiment, density unevenness caused by settlement of the microparticles in the functional ink in a line head can be eliminated.

Note that here, the terms "main scanning direction" and "sub-scanning direction" are used with the following meanings. When the nozzles are driven in a full line head having nozzle arrays corresponding to the entire width of the recording paper, a nozzle driving operation such as (1) driving all of the nozzles simultaneously, (2) driving the nozzles in sequence from one nozzle to another, or (3) dividing the nozzles into blocks and driving the nozzles in block sequence from one block to another, is performed. Main scanning is defined as performing one of these operations such that one line (a line constituted by a single dot array or a line constituted by a plurality of dot arrays) is printed in the width direction of the paper (the orthogonal direction to the recording paper conveyance direction). The direction of the line (the lengthwise direction of a strip-form area) recorded by the main scanning operation is known as the main scanning direction.

Meanwhile, sub-scanning is defined as printing the line (a line constituted by a single dot array or a line constituted by a plurality of dot arrays) formed by the main scan described above repeatedly by moving the full line head and recording paper relatively to each other as described above. The direction in which this sub-scan is performed is known as the sub-scanning direction. In short, the recording paper conveyance direction is the sub-scanning direction, and the orthogonal direction thereto is the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor or the like) for capturing an image of the ink-droplet deposition result of the print unit 12, and functions as a device to check for ejection defects such as clogs of the nozzles from the ink-droplet deposition images read by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements that are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed immediately before the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Figure 3:
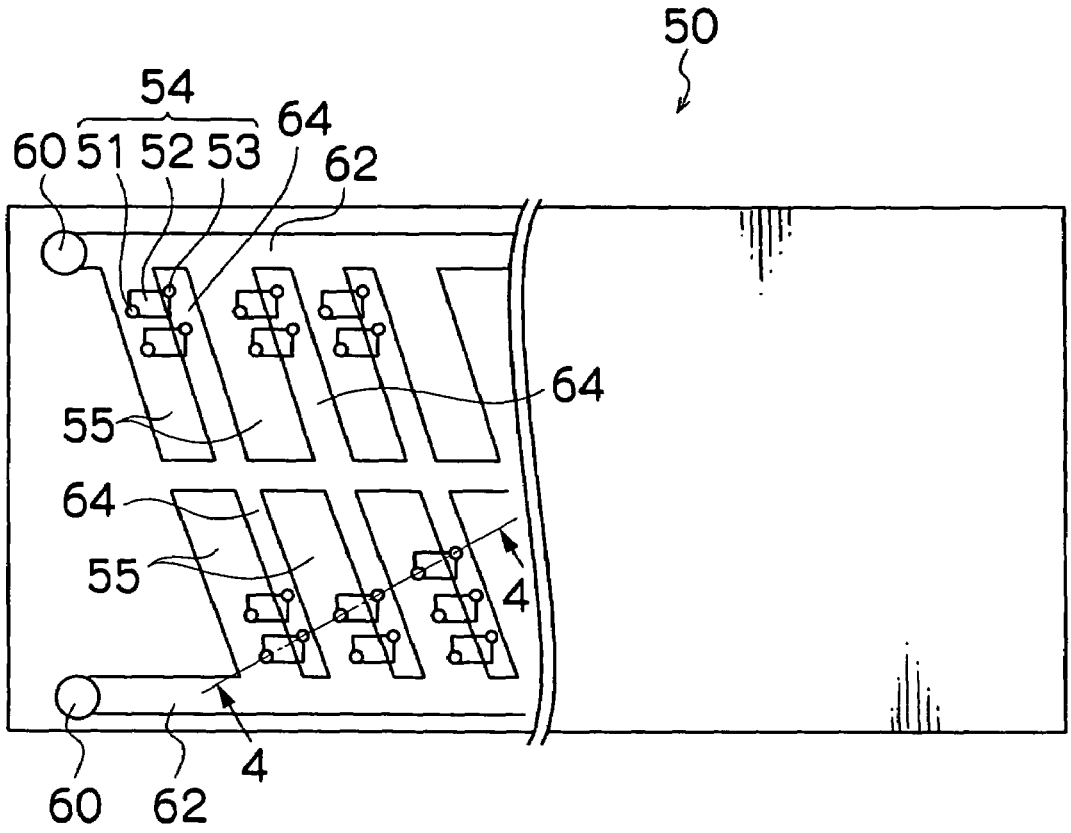
FIG. 3 is a perspective plan view of a print head of the first embodiment.

Next, the print head (liquid droplet ejection head) is described. The print heads 12K, 12C, 12M, and 12Y provided respectively for ink colors have a common structure, and hence in the following description, a print head serving as a representative thereof is described using the reference numeral 50. FIG. 3 shows a perspective plan view of the print head 50 according to the first embodiment.

As shown in FIG. 3, ink supply ports 60 are provided at an end portion of the print head 50 of this embodiment, and the print head 50 receives a supply of ink (functional ink containing dispersed microparticles) from a tank (ink storage tank) of the ink storing and loading unit 14 (see FIG. 1) through a pipe (neither the tank nor the pipe are shown in FIG. 3).

A main ink flow 62 is formed in a lengthwise direction of the print head 50 from the ink supply port 60. A plurality of common liquid chambers (ink tributaries) 55 are formed so as to bifurcate from the main ink flow 60 and extend in a diagonal direction to the breadthways direction of the print head 50, as shown in FIG. 3.

A plurality of pressure chamber units 54, each comprising a nozzle 51, a pressure chamber 52, and a supply port 53, are arranged along the common liquid chamber 55, and thereby the pressure chamber units 54 are arranged in the form of a staggered two-dimensional matrix over the entire print head 50. As is described in detail below, the supply port 53 of each pressure chamber unit 54 is formed in a partition wall 64 between common liquid chambers 55.

In the print head 50 constituted as described above, the ink that is supplied to the print head 50 through the ink supply port 60 flows along the main ink flow 62 and is thus supplied to each of the common liquid chambers 55 which branch from the main ink flow 62. The ink is then supplied from the common liquid chambers 55 to the pressure chambers 52 through the supply ports 53 of the pressure chamber units 54 formed along each common liquid chamber 55.

Although not shown in FIG. 3, a plurality of short heads constituted in this manner may be arranged in a two-dimensional staggered form and connected such that the plurality of short heads form a single, elongated full-line head having an overall length which corresponds to the entire width of the print medium.

In this embodiment, functional ink containing dispersed microparticles is ejected, and hence the structure of the print head 50 has been designed to eliminate visible density unevenness in the ejection result with a reasonably-priced device, even when the microparticles of the functional ink in the common liquid chamber 55 settle such that the concentration of the microparticles differs between the upper layer portion and lower layer portion of the ink, for example.

This is now described below.

Figure 4:
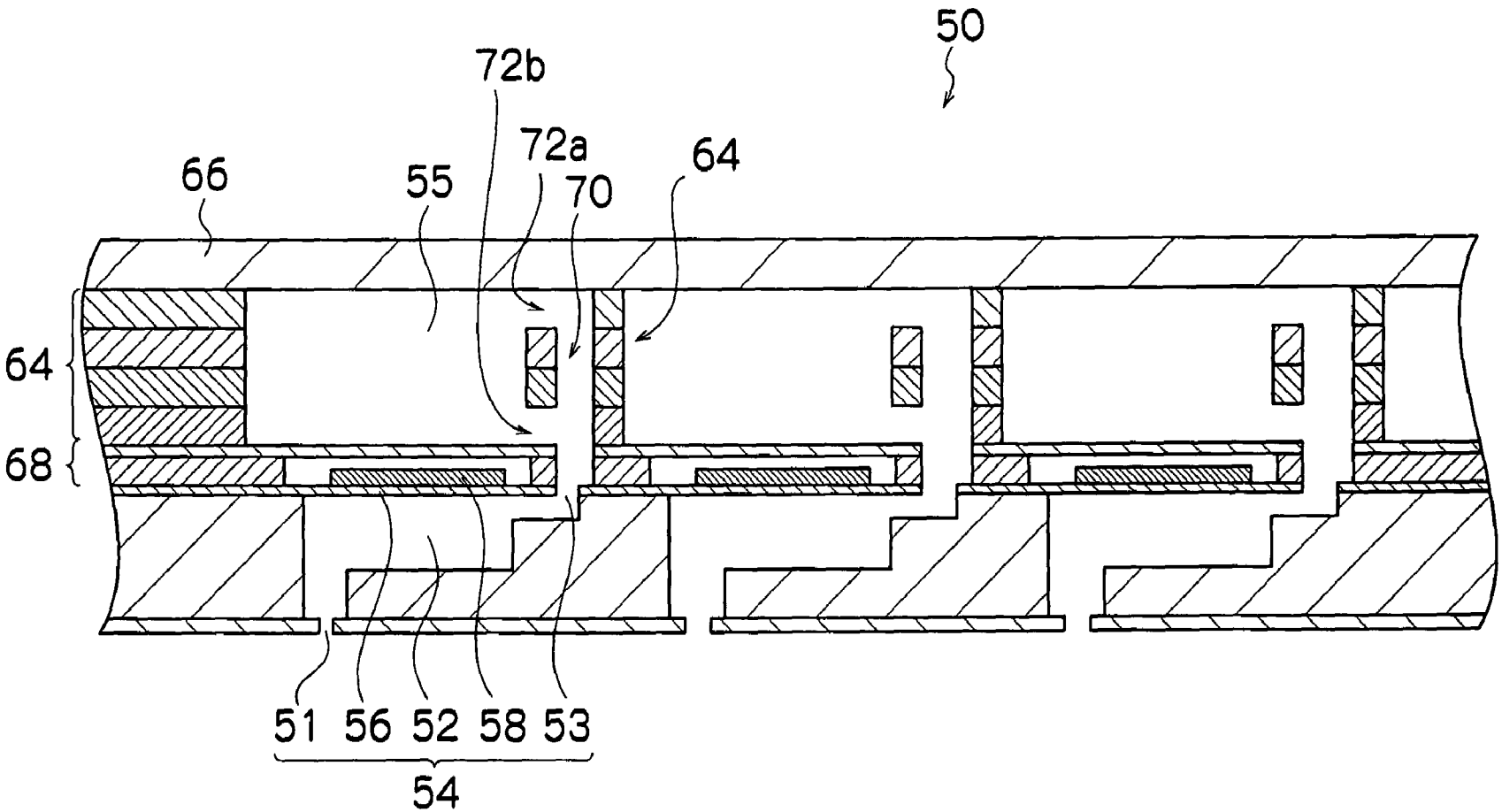
FIG. 4 is a sectional view along a line 4-4 in FIG. 3.

FIG. 4 is a sectional view along a line 4-4 of FIG. 3.

As shown in FIG. 4, each pressure chamber unit 54 comprises the pressure chamber 52 communicating with the nozzle 51 that ejects the ink. Ink is supplied to the pressure chamber 52 from the common liquid chamber (tributary) 55 through the supply port 53.

The common liquid chamber 55 is a space formed by the partition wall 64 and a ceiling plate 66, which are formed by etching metallic thin plates and are superimposed on each other, and stores the ink that is to be supplied to the pressure chamber 52. A diaphragm 56 forms the upper surface of the pressure chamber 52, and a piezoelectric element 58 is formed thereon. By driving the piezoelectric element 58, the diaphragm 56 deforms such that pressure is applied to the ink in the pressure chamber 52, and thus the ink is ejected through the nozzle 51. A piezo cover 68 is formed to ensure that the piezoelectric element 58 is driven and also to protect the piezoelectric element 58.

Further, a supply passage 70 for supplying ink to each of the pressure chambers 52 is formed in the partition wall 64 of the common liquid chamber 55. As shown in FIG. 4, holes 72*a* and 72*b* are formed respectively at the upper portion and lower portion of the supply passage 70, and the supply passage 70 communicates with the supply port 53 leading to the pressure chamber 52 on the lower side thereof. The cross-section of the supply passage 70 may take an arbitrary form such as a square or circular form, and the sectional area thereof is preferably set in accordance with the ink supply amount. In particular, the upper side hole 72*a* preferably has a larger diameter than the lower side hole 72*b*. The holes 72*a* and 72*b* are formed to face in the horizontal direction.

The reason for providing the holes 72*a* and 72*b* in the upper portion and lower portion of the supply passage 70 provided in the partition wall 64 is as follows. When the microparticles in the functional ink in the common liquid chamber 55 settle such that the microparticle concentration in the lower layer portion of the ink in the common liquid chamber 55 rises and the microparticle concentration in the upper layer portion falls, ink containing a high concentration of microparticles is taken into the supply passage 70 through the lower portion hole 72*b* and ink containing a low concentration of microparticles is taken into the supply passage 70 through the upper portion hole 72*a*. As a result, the microparticle concentration of the ink that is supplied to the pressure chamber 52 is evened out to as great an extent as possible.

The number of holes is not limited to two. Note, however, that the hole in the vicinity of the upper surface is preferably set appropriately in consideration of a function, to be described below, for stirring the microparticles dispersed throughout the ink.

Further, there are no particular limitations on the constitution of drive wires for the piezoelectric elements 58, and a drive wire which penetrates the partition wall 64 in which the supply passage 70 is formed or a drive wire formed in an intermediate plate (the piezo cover 68) which protects the piezoelectric element 58 may be provided. However, a structure in which the drive wire penetrates the partition wall 64 is more suitable for a high density arrangement.

Figure 5A:
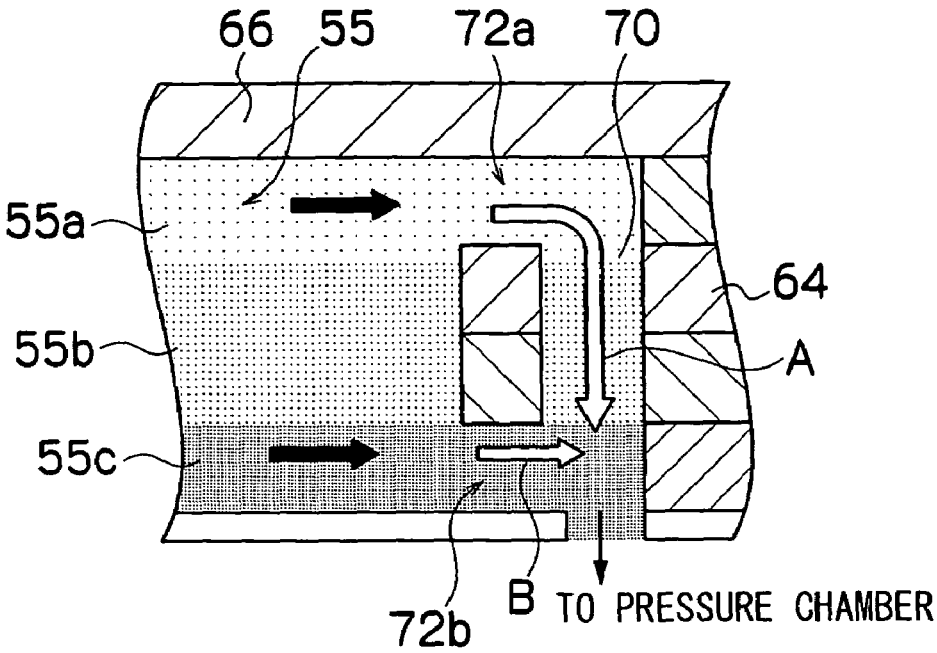
FIG. 5A is an illustrative view showing a condition during ink supply.
Figure 5B:
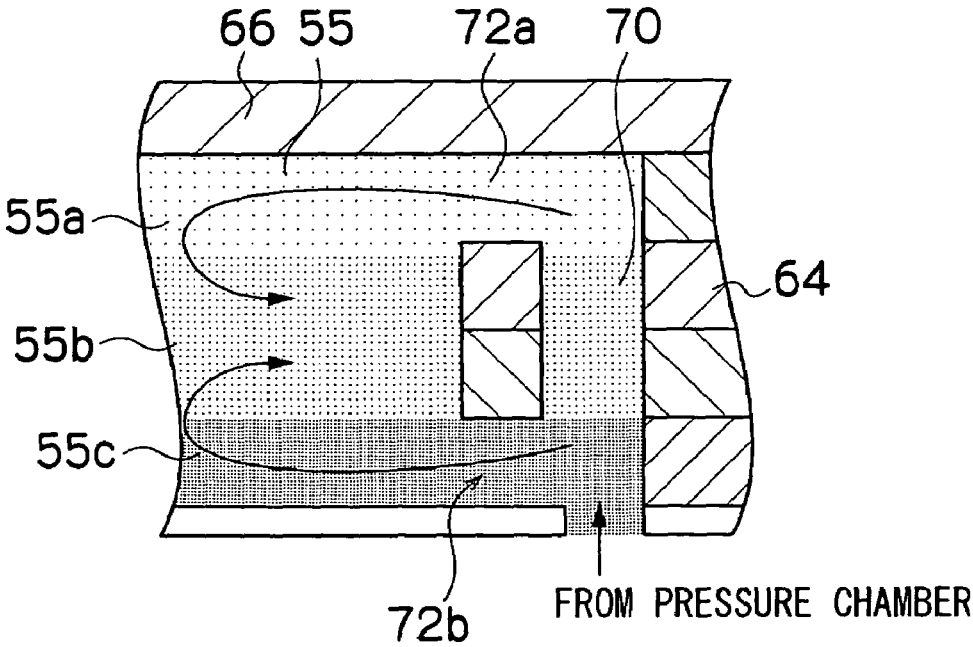
FIG. 5B is an illustrative view showing a condition during ink ejection.

Next, a process for evening out the microparticle concentration of the ink is described. FIGS. 5A and 5B show an enlargement of the vicinity of the supply passage 70. FIG. 5A illustrates a condition during ink supply, and FIG. 5B illustrates a condition during ink ejection.

As shown in FIG. 5A, the dispersed microparticles of the functional ink in the common liquid chamber (tributary) 55 settle over time, so that the ink in a lower layer portion 55c has the greatest microparticle concentration, the ink in an upper layer portion 55a has the smallest microparticle concentration, and the ink in a middle layer portion 55b has an intermediate microparticle concentration.

During ink supply, the ink having a low microparticle concentration flows through the hole 72*a* provided in the upper portion of the supply passage 70, and the ink having a high microparticle concentration flows through the hole 72*b* provided in the lower portion of the supply passage 70. These inks intermingle with each other and the mixed ink is supplied to the pressure chamber 52 through the supply port 53. In this way, the microparticle concentration of the ink can be evened out to a certain extent.

As shown by arrows A and B in FIG. 5A, in order to ensure that the high concentration ink and low concentration ink intermingle evenly, the diameter of the holes 72*a*, 72*b* and the shape of the supply passage 70 are set so that the passage resistance within a range A extending from the upper portion hole 72*a* to the lower portion of the supply passage 70 is equal to the passage resistance within a range B extending from the lower portion hole 72*b* to the supply passage 70. For example, the inner diameter of the supply passage 70 is preferably set to decrease steadily from the upper portion to the lower portion, and the upper portion hole 72*a* is preferably set to have a greater diameter than the lower portion hole 72*b*.

In this manner, high concentration ink and low concentration ink are supplied to the pressure chamber 52 and mixed together so that ink having a constant concentration can be ejected. Further, in this case, by setting the proportions in which the high concentration ink and low concentration ink are supplied to the pressure chamber 52 according to the opening area of the supply port 53, structural simplicity and easy setting can be achieved.

As shown in FIG. 5B, during ink ejection, a backflow of ink from the pressure chamber 52 side to the supply passage 70 side is created by the pressure generated during ink ejection. As shown by the arrows in FIG. 5B, this ink flows into the common liquid chamber 55 through the upper portion hole 72*a* and the lower portion hole 72*b*, and as a result of this ink flow, the ink in the common liquid chamber 55 is stirred, thereby preventing settlement of the microparticles.

According to the present embodiment, since the holes 72*a* and 72*b* formed in the supply passage 70 face in the horizontal direction, the common liquid chamber 55 can be kept rigid and the ink in the common liquid chamber 55 can be stirred effectively.

According to this embodiment, functional ink can be ejected with a substantially constant microparticle concentration by the head having a simple structure, even when the microparticles dispersed through the functional ink settle.

Next, a second embodiment of the present invention is described.

Figure 6:
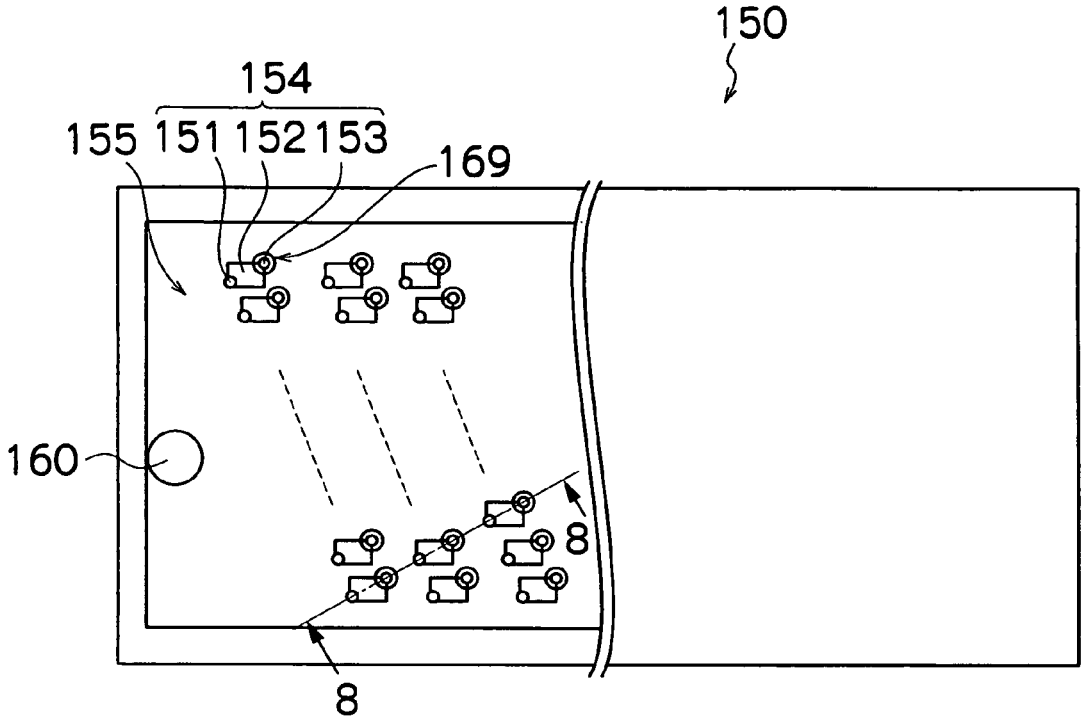
FIG. 6 is a perspective plan view of a print head according to a second embodiment of the present invention.

FIG. 6 is a perspective plan view of a print head according to the second embodiment.

As shown in FIG. 6, an ink supply port 160 is provided at an end portion of a print head 150 of this embodiment, and the print head 150 receives a supply of ink (functional ink containing dispersed microparticles) from a tank (ink storage tank) of the ink storing and loading unit 14 (see FIG. 1) through a pipe (neither the tank nor the pipe are shown in FIG. 6).

Unlike the print head 50 of the first embodiment where a main ink flow and tributaries (common liquid chambers) are provided, the print head 150 of this embodiment includes an integral common liquid chamber 155 that extends over the entire print head 150, as shown in FIG. 6.

As shown in FIG. 6, in the print head 150 of this embodiment, a plurality of pressure chamber units 154, each comprising a nozzle 151, a pressure chamber 152, and a supply port 153, are arranged over the entire print head 150 in a staggered two-dimensional matrix form, similarly to the first embodiment. A tubular body 169 having an internally-formed supply passage (not shown in FIG. 6; to be described below) which communicates with the supply port 153 is formed on the upper portion of each supply port 153 for supplying ink to each of the pressure chambers 152.

Figure 7:
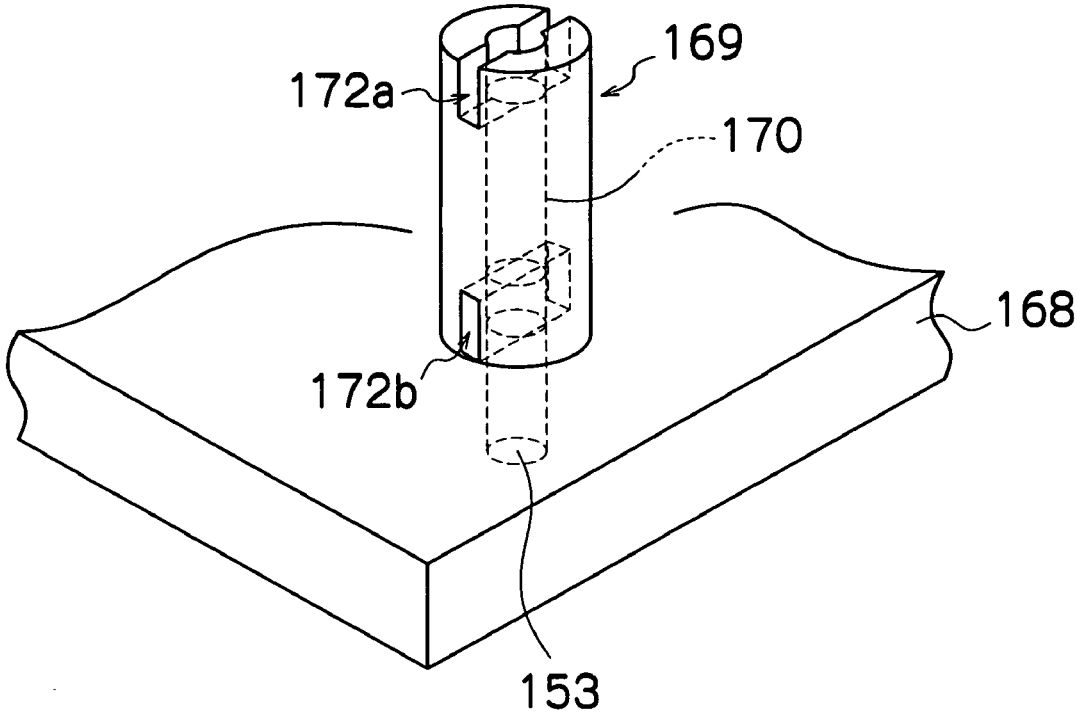
FIG. 7 is an enlarged perspective view showing a tubular body in FIG. 6.

FIG. 7 shows an enlarged perspective view of one of the tubular bodies 169.

As shown in FIG. 7, the tubular body 169 is provided substantially vertically on a piezo cover 168 (to be described below). A hollow portion in the center of the tubular body 169 serves as a supply passage 170, and the lower portion of the supply passage 170 communicates with the supply port 153 for supplying ink to the pressure chamber 152. Although not shown in FIG. 7, the upper portion of the tubular body 169 is joined to the ceiling plate of the common liquid chamber 155.

Slit-form holes 172*a* and 172*b*, each taking the form of a rectangular parallelepiped, are provided respectively in the upper portion and lower portion of the tubular body 169 so as to communicate with the supply passage 170. The common liquid chamber 155 exists on the periphery of the tubular body 169, and hence the ink in the common liquid chamber 155 is supplied into the supply passage 170 through these holes 172*a* and 172*b*.

Figure 8:
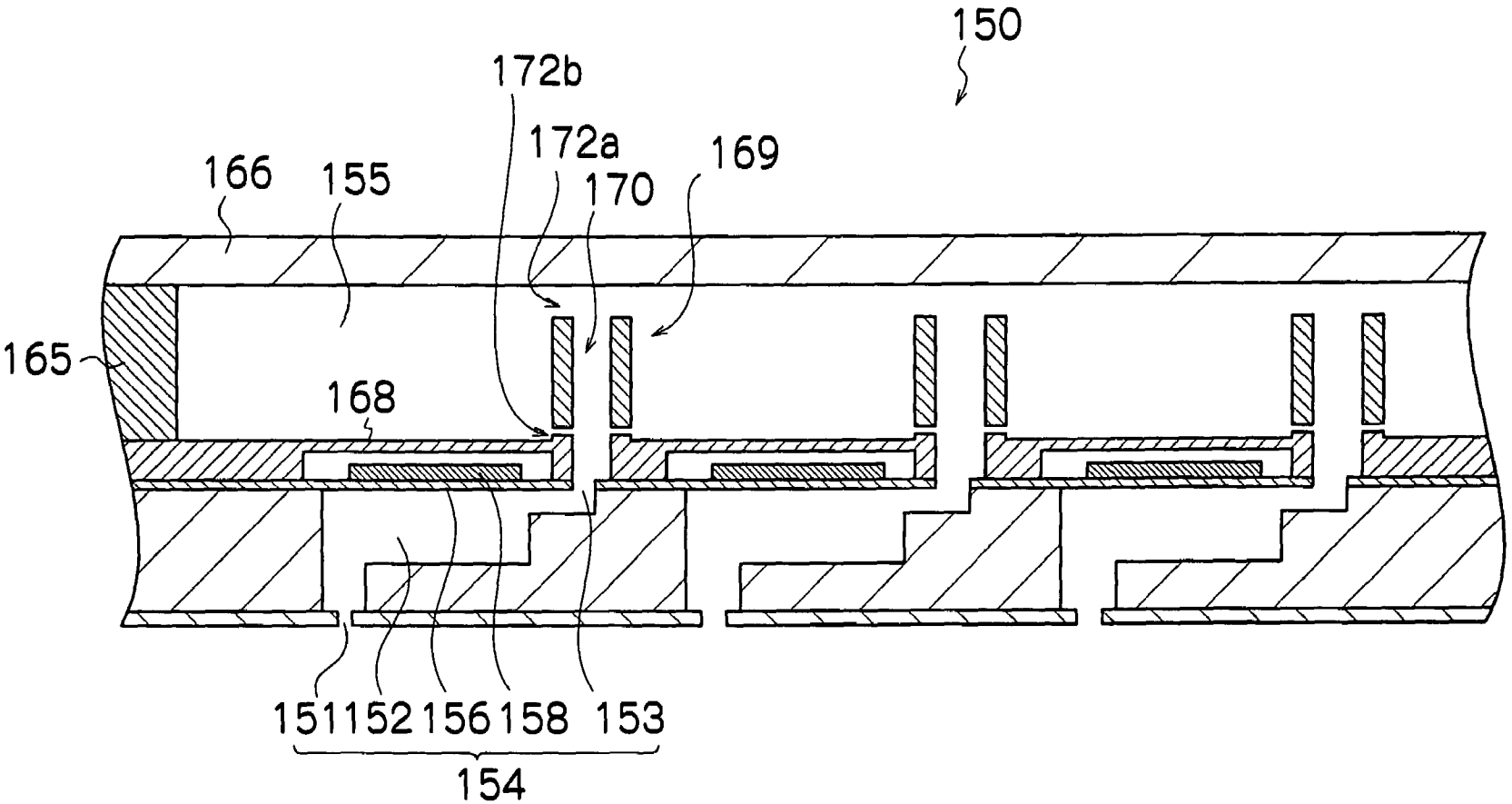
FIG. 8 is a sectional view along a line 8-8 in FIG. 6.

FIG. 8 is a sectional view along a dot/dash line 8-8 in FIG. 6.

As shown in FIG. 8, likewise in this embodiment, the pressure chamber unit 154 comprises the pressure chamber 152 communicating with the nozzle 151 that ejects the ink, and ink is supplied from the common liquid chamber 155 to the pressure chamber 152 through the supply port 153.

The common liquid chamber 155 is a single space formed over the entire print head 150 by a side wall 165 formed around the periphery of the print head 150 and a ceiling plate 166. The common liquid chamber 155 stores the ink that is to be supplied to each of the pressure chambers 152.

A diaphragm 156 is disposed so as to form the upper surface of each pressure chamber 152, and piezoelectric elements 158 are formed thereon. By driving a piezoelectric element 158, the diaphragm 156 deforms such that pressure is applied to the ink in the corresponding pressure chamber 152, and thus the ink is ejected through the nozzle 151. The piezo cover 168 is formed to ensure that the piezoelectric element 158 is driven and also to protect the piezoelectric element 158.

The tubular body 169 is formed upright on the upper side of the part of the piezo cover 168 corresponding to the supply port 153, and the supply passage 170 in the central portion of the tubular body 169 communicates with the supply port 153. The slit-form holes 172*a* and 172*b* are formed in the upper portion and lower portion of the tubular body 169, respectively. The cross-section shown in FIG. 8 has been cut at the hole 172*a* part, and therefore the upper portion of the tubular body 169 does not appear to be joined to the ceiling plate 166 in FIG. 8. But in actuality, as described above, the upper portion of the tubular body 169 is joined to the ceiling plate 166 of the common liquid chamber 155.

Hence, the supply ports (the slit-form holes 172*a* and 172*b*) formed in the tubular body 169 are provided in a plurality (two in the embodiments shown in FIGS. 7 and 8) at an identical height on the outer periphery of the tubular body 169, and also provided in a plurality in the height direction (in the embodiments shown in FIGS. 7 and 8, in two locations, i.e. the upper portion and lower portion). By forming a plurality of supply ports (the slit-form holes 172*a* and 172*b*) at different heights, the settled microparticles in the functional ink can be stirred more effectively.

Note that the piezo cover 168 and tubular body 169 are preferably formed integrally through resin molding. By forming the common liquid chamber 155 integrally with the print head 150 rather than in a tributary structure, and forming the tubular bodies 169 within the common liquid chamber 155, the passage resistance in the common liquid chamber 155 decreases, which is useful for ejecting highly viscous liquid, and the rigidity of the common liquid chamber 155 can be ensured. Note, however, that it is not necessary that all of the tubular bodies 169 should be joined to the ceiling plate 166 of the common liquid chamber 155 to serve as support pillars supporting the ceiling plate 166.

Although not shown in FIG. 8, a drive wire for each piezoelectric element 158 is provided horizontally on the piezo cover 168.

According to this embodiment, functional ink can be ejected with a substantially constant microparticle concentration using a simple structure, even when the microparticles dispersed through the functional ink settle.

Next, a third embodiment of the present invention is described.

Figure 9:
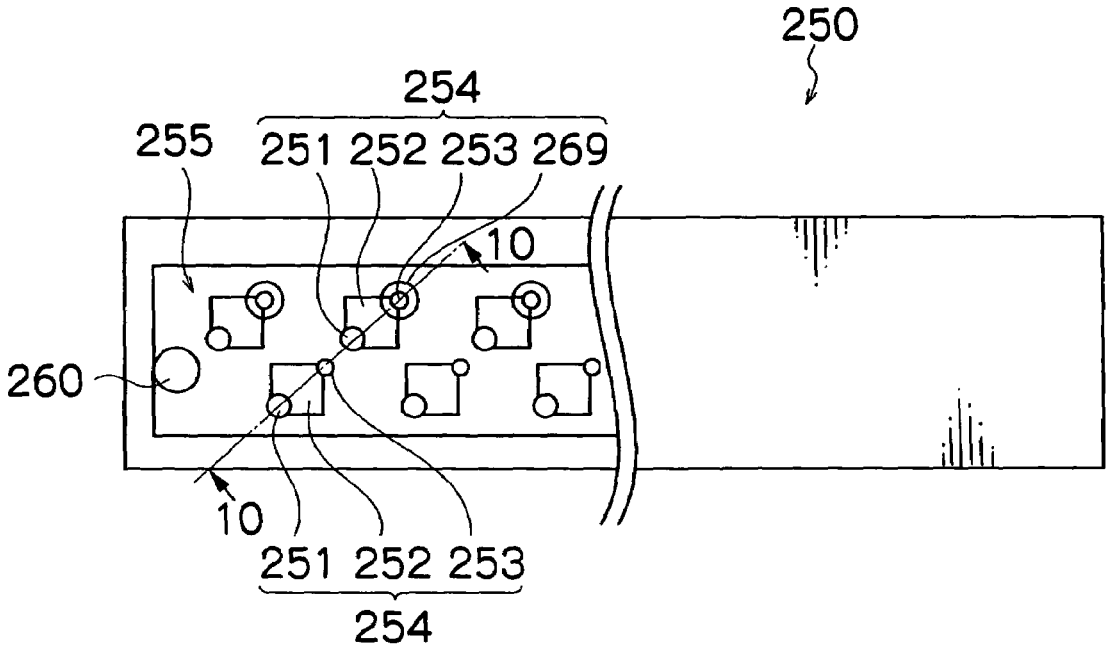
FIG. 9 is a perspective plan view of a print head according to a third embodiment of the present invention.

FIG. 9 is a perspective plan view of a print head according to the third embodiment.

As shown in FIG. 9, an ink supply port 260 is provided at an end portion of a print head 250 of this embodiment, and the print head 250 receives a supply of ink (functional ink containing dispersed microparticles) from a tank of the ink storing and loading unit 14 (see FIG. 1) through a pipe. Similarly to the second embodiment, an integral common liquid chamber 255 that extends over the entire print head 250 is provided in the print head 250 of this embodiment.

As shown in FIG. 9, in the print head 250 of this embodiment, pressure chamber units 254, each comprising a nozzle 251, a pressure chamber 252, and a supply port 253, are arranged in two staggered rows. Note that the pressure chamber units 254 are arranged in two staggered rows for ease of description, and may be arranged in a two-dimensional matrix.

Of the pressure chamber units 254 arranged in the two rows, the supply ports 253 leading to the pressure chambers 252 arranged on the lower side of FIG. 9 are formed with a supply passage that enables ink to be supplied directly to the pressure chamber 252 from the common liquid chamber 255, whereas the supply ports 253 leading to the pressure chambers 252 arranged on the upper side of FIG. 9 are each formed with a tubular body 269 having a supply passage which communicates with the corresponding supply port 253.

Figure 10:
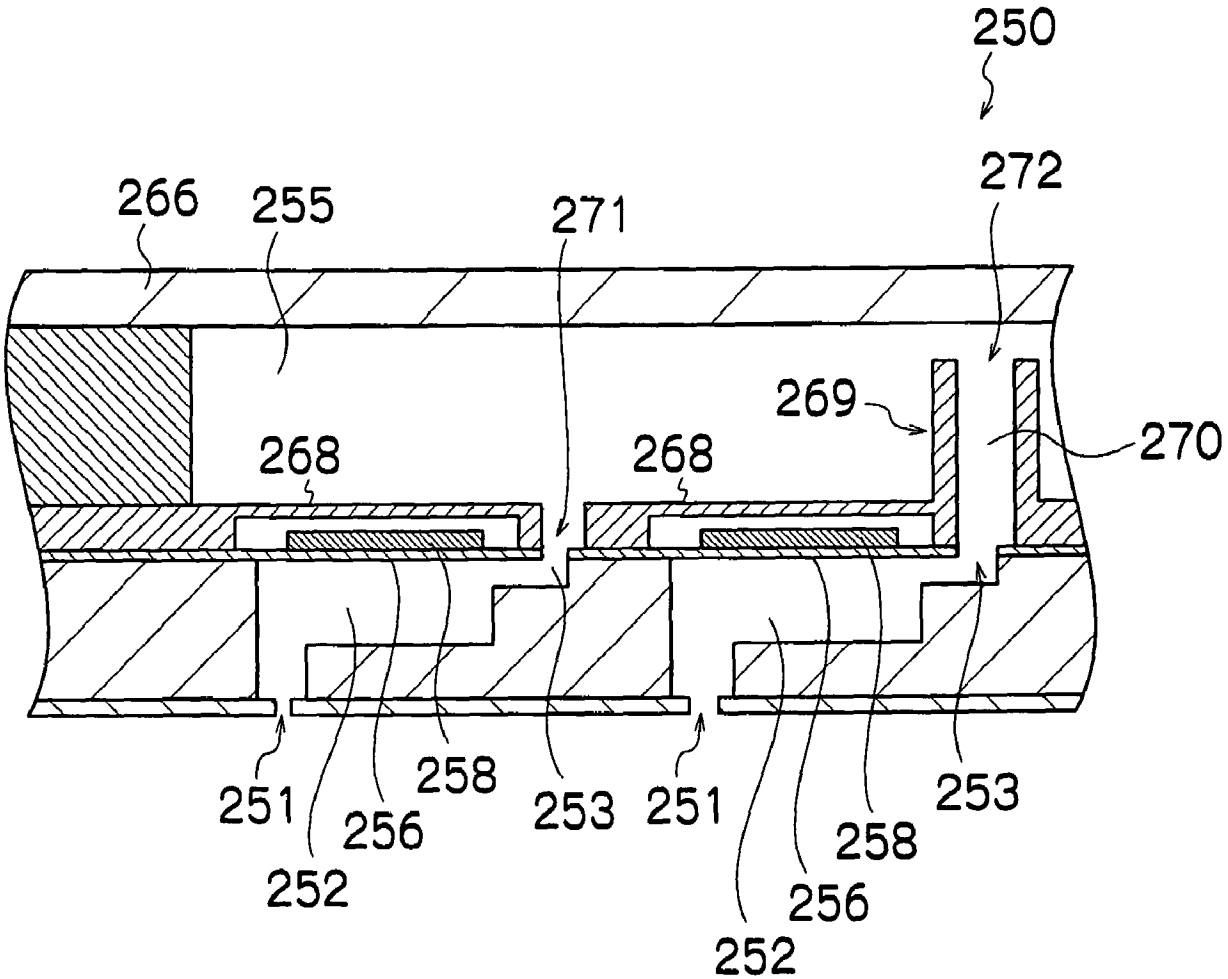
FIG. 10 is a sectional view along a line 10-10 in FIG. 9.

To illustrate this, FIG. 10 shows a cross-section taken along a line 10-10 of FIG. 9.

As shown in FIG. 10, a supply port 253 provided with a pressure chamber 252 of each of the pressure chamber units 254 arranged on one of the two rows is structured so that high-concentration ink is supplied directly to the pressure chamber 252 from the lower layer portion of the common liquid chamber 255 through a supply passage 271 formed in the diaphragm 256 and the piezo cover 268.

Meanwhile, for a supply port 253 provided with the pressure chamber 252 of each of the pressure chamber units 254 arranged on the other row, a tubular body 269 is formed on the piezo cover 268, and the cavity in the center of the tubular body 269 serves as a supply passage 270. Only the upper end portion of the tubular body 269 is open, and therefore only the ink in the upper layer portion of the common liquid chamber 255 is supplied through the tubular body 269 to the pressure chamber 252.

The ink droplets that are ejected through the nozzles 251 that communicate respectively with the two pressure chambers 252 shown in FIG. 10 form adjacent dots in the main scanning direction (the lengthwise direction of the print head 250) on the recording medium. High-concentration ink is ejected from one of the nozzles 251, and low-concentration ink is ejected from the other nozzle 251, the ink droplets form adjacent dots on the recording medium, and therefore high-concentration ink dots and low-concentration ink dots are formed side-by-side on the recording medium so that even though the concentration of the dots is different, no visible density unevenness occurs on the recording medium.

As for the pressure chamber units 254 which form adjacent dots on the recording medium according to this embodiment, ink is taken in each of the pressure chamber units 254 from the common liquid chamber 255 through a single supply port, and the supply ports of the pressure chamber units 254 are formed at different heights in the common liquid chamber 255.

Figure 11:
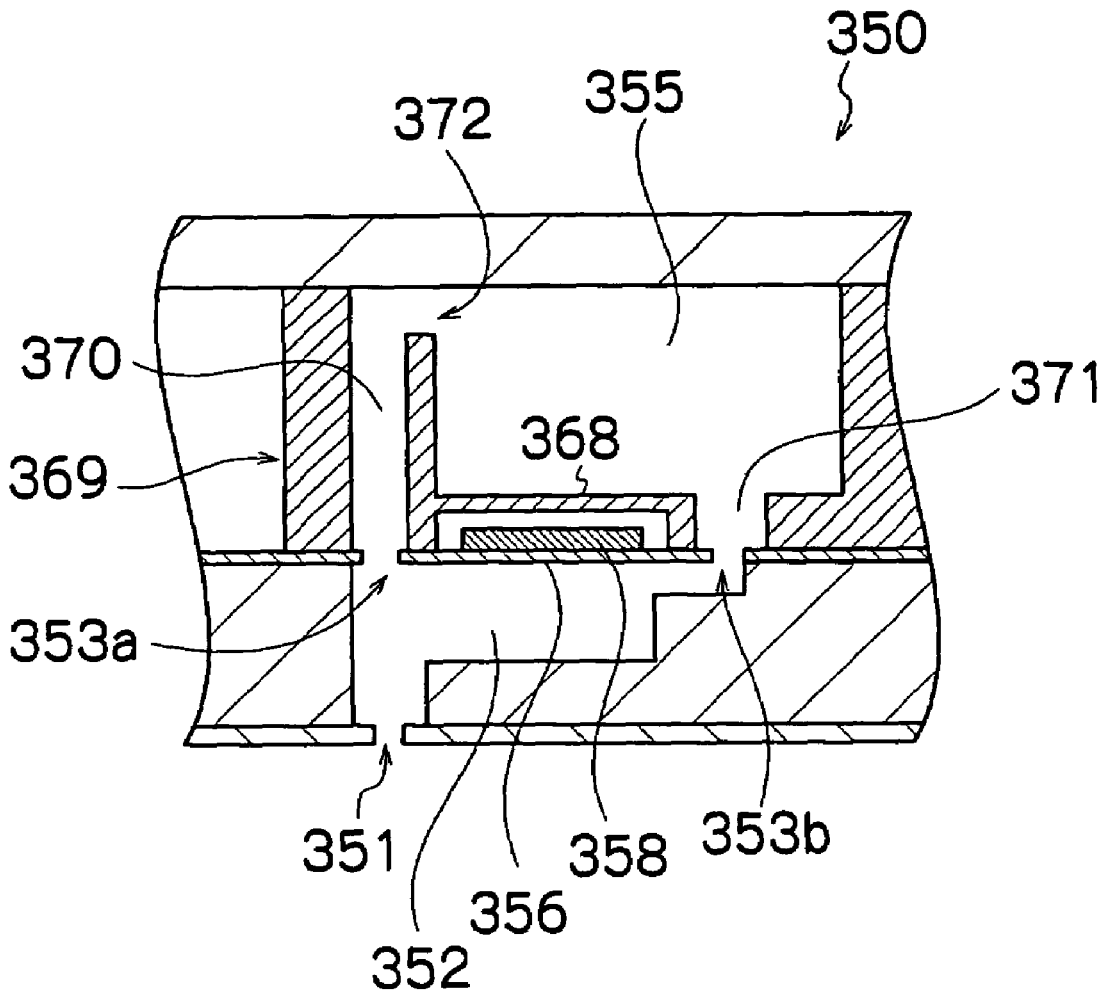
FIG. 11 is a sectional view showing another example of the print head of the third embodiment.

In contrast, as shown in FIG. 11, for example, two supply passages communicating with a common liquid chamber 355 and two supply ports (353*a* and 353*b*) may be provided in relation to a single pressure chamber 352, and the heights of the ink intake ports which are formed for the two supply passages (the two supply ports 353*a* and 353*b*) and into which ink flows from the common liquid chamber 355 may be set to differ.

More specifically, as shown in FIG. 11, each pressure chamber 352 is provided with the two supply ports 353*a* and 353*b* so as to communicate with supply passages 370 and 371. The supply passage 370 communicating with one of the supply ports, 353*a*, is formed as the hollow portion of a tubular body 369 formed on a piezo cover 368, and takes ink in through the upper portion of the tubular body 369. Meanwhile, the supply passage 371 communicating with the supply port 353*b* penetrates a diaphragm 356 and the piezo cover 368, and takes ink in from the lower layer side of the common liquid chamber 355. Thus, the ink that is supplied to the pressure chamber 352 is taken in from different positions in the height direction of the common liquid chamber 355.

In this embodiment, the tubular bodies are provided in the pressure chamber units on only one of the two rows, and hence settlement of the microparticles in the functional ink can be dealt with by means of a simple structure that can be manufactured easily.

In each of the embodiments described above, a common liquid chamber is formed on the opposite side of a piezoelectric element to a pressure chamber, but the present invention is not limited to a print head constituted in this manner.

Figure 12A:
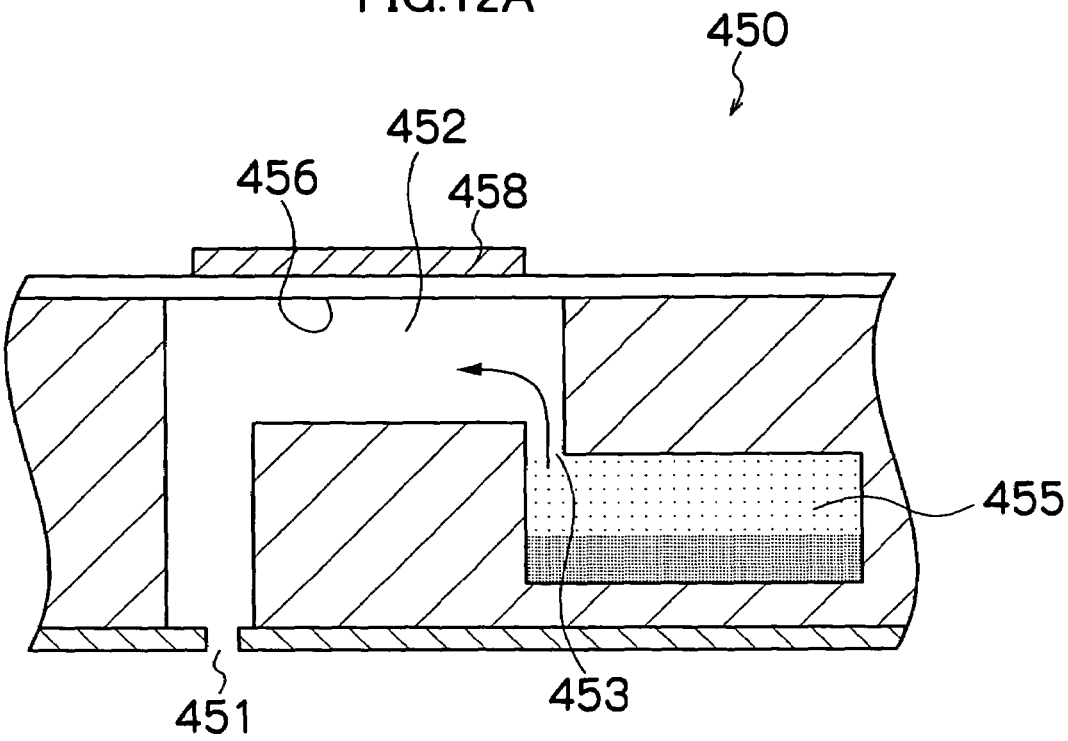
FIG. 12A is a sectional view showing an embodiment of another print head to which the present invention is applicable.
Figure 13A:
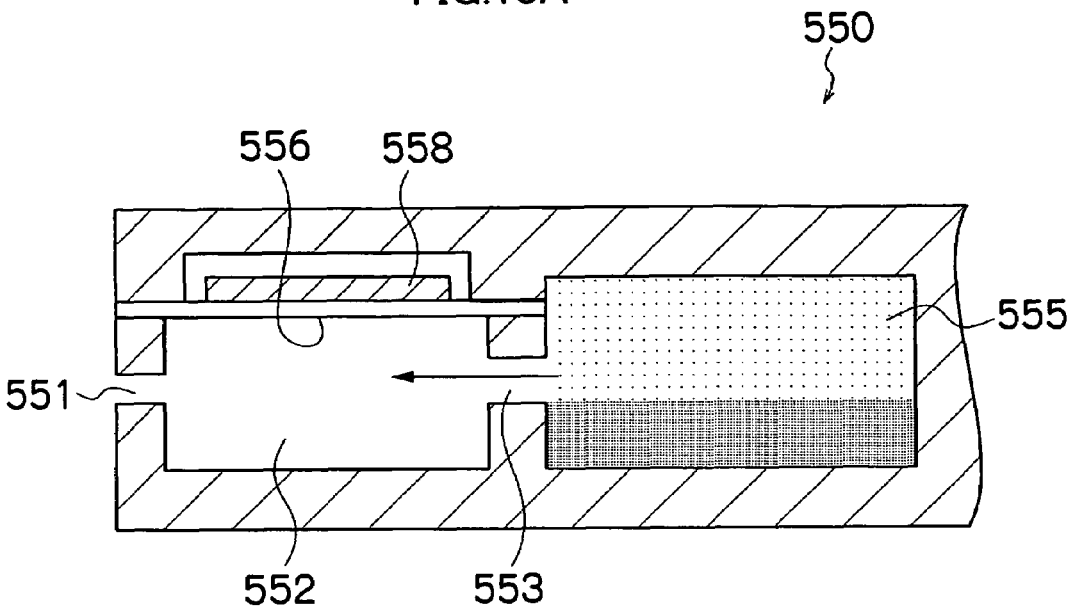
FIG. 13A is a sectional view showing an embodiment of another print head to which the present invention is applicable.
Figure 13B:
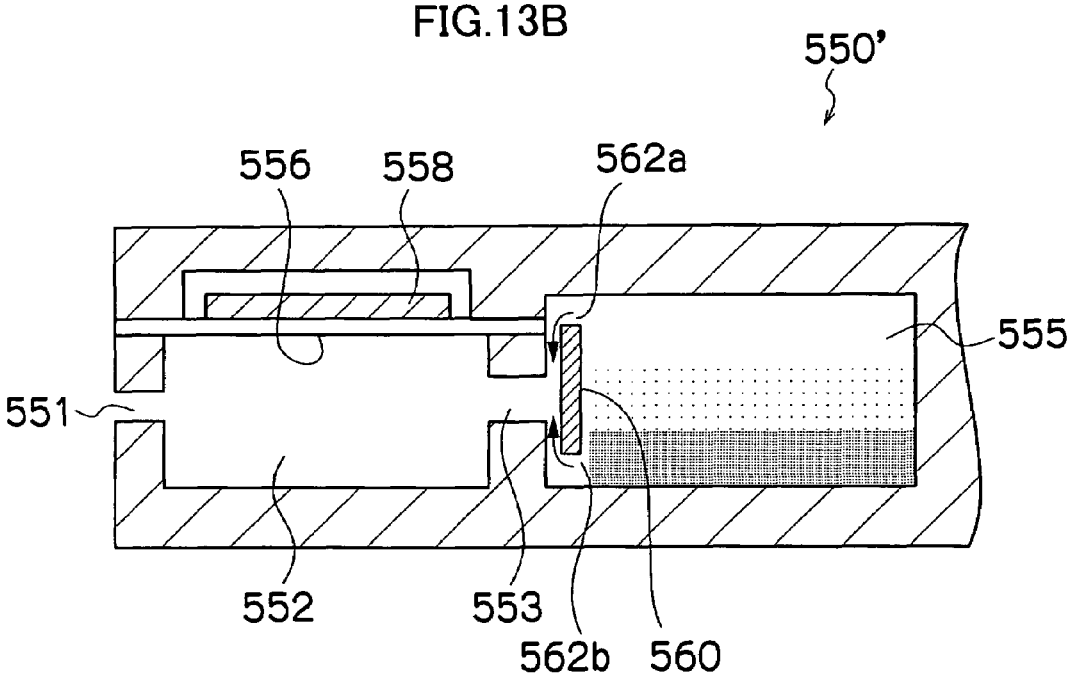
FIG. 13B is a sectional view showing an embodiment in which the present invention is applied to the print head of FIG. 13A.

For example, the present invention is also applicable to a print head 450 such as that shown in FIG. 12A, in which a common liquid chamber 455 is formed on the same side of a piezoelectric element 458 as a pressure chamber 452, or to a so-called side-shooter type print head 450 such as that shown in FIG. 13A, in which ink is ejected in a perpendicular direction to a driving direction (deforming direction) of a piezoelectric element 558 disposed in a pressure chamber 552.

Likewise in the embodiments shown in FIGS. 12A and 13A, the microparticles in the functional ink stored in the common liquid chamber 455 or 555 settle due to gravity, and as a result, the lower layer of the ink has a high microparticle concentration and the upper layer has a low microparticle concentration.

Figure 12B:
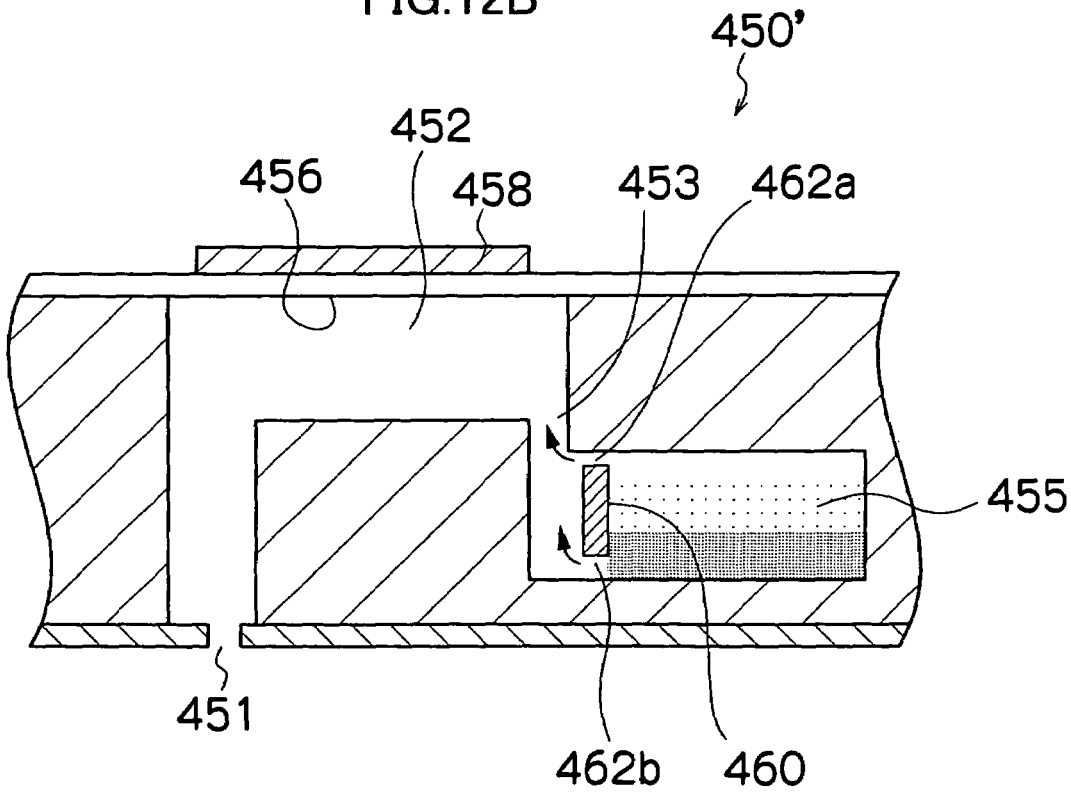
FIG. 12B is a sectional view showing an embodiment in which the present invention is applied to the print head of FIG. 12A.

Therefore, a supply passage having a plurality of ink intake ports in different positions in the direction of gravitational force is provided in the common liquid chamber. In the embodiment shown in FIG. 12A, for example, a member 460 having slits 462*a* and 462*b* in the upper portion and lower portion of the common liquid chamber 455 is provided in front of the supply port 453 (before the supply port 453), as shown in FIG. 12B, and thus the low-concentration ink in the upper layer portion of the common liquid chamber 455 and the high-concentration ink in the lower layer portion thereof are taken into the pressure chamber 30 452 simultaneously. Likewise in the embodiment shown in FIG. 13A, a member 560 having slits 562*a* and 562*b* in the upper portion and lower portion of the common liquid chamber 555 is provided in front of the supply port 553 (before the supply port 553), and thus the low-concentration ink in the upper layer portion of the common liquid chamber 555 and the high-concentration ink in the lower layer portion thereof are taken into the pressure chamber 552 simultaneously. By taking in the high-concentration ink and low-concentration ink simultaneously in this manner so that the ink intermingles, the concentration of the ink can be evened out to a certain extent, and hence density unevenness on the recording medium can be made difficult to recognize with eyes.

As described above, by providing a plurality of supply ports leading into the pressure chamber from the common liquid chamber in different positions in the direction of gravitational force, liquid can be ejected at a constant concentration or a constant density even when microparticles in the liquid settle.

The liquid droplet ejection head and image forming apparatus according to embodiments of the present invention are described in detail above, but the present invention is not limited to the above embodiments, and may be subjected to various improvements and modifications within a scope that does not depart from the spirit of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection head comprising:

a nozzle which ejects a droplet of a liquid containing microparticles;

a pressure chamber which connects with the nozzle;

a piezoelectric element which varies a volume of the pressure chamber;

a common liquid chamber which stores the liquid that is to be supplied to the pressure chamber; and a supply passage which connects the common liquid chamber to the pressure chamber, wherein the supply passage has a plurality of supply ports through which the common liquid chamber is connected to the supply passage, the supply ports being disposed in different positions in a direction of gravitational force, and an upper supply port of said supply passage having a larger diameter than a diameter of a lower supply port.

2. A liquid droplet ejection head comprising:

nozzles which respectively eject droplets of a liquid containing microparticles onto a recording medium;

pressure chambers which respectively connect with the nozzles;

piezoelectric elements which respectively vary volumes of the pressure chambers;

at least one common liquid chamber which stores the liquid to be supplied to the pressure chambers; and supply passages which connect the at least one common liquid chamber to the pressure chambers, wherein the droplets ejected from the nozzles are adjacent to each other on the recording medium; and the supply passages respectively have supply ports through which the at least one common liquid chamber is connected to the supply passages, the supply ports being disposed in different positions in a direction of gravitational force, and an upper supply port of said supply passages having a larger diameter than a diameter of a lower supply port.

3. A liquid droplet ejection head comprising:

a nozzle which ejects a droplet of a liquid containing microparticles;

a pressure chamber which connects with the nozzle;

a piezoelectric element which varies a volume of the pressure chamber;

a common liquid chamber which stores the liquid that is to be supplied to the pressure chamber; and supply passages which connect the common liquid chamber to the pressure chamber, wherein the supply passages respectively have supply ports through which the common liquid chamber is connected to the supply passages, the supply ports being disposed in different positions in a direction of gravitational force, and an upper supply port of said supply passages having a larger diameter than a diameter of a lower supply port.

4. An image forming apparatus comprising the liquid droplet ejection head as defined in claim 1.

5. An image forming apparatus comprising the liquid droplet ejection head as defined in claim 2.

6. An image forming apparatus comprising the liquid droplet ejection head as defined in claim 3.

* * * * *